US005349273A

United States Patent [19]

Pacholok

[11] Patent Number: 5,349,273

[45] Date of Patent: Sep. 20, 1994

[54] DIMMER AND GROUND FAULT INTERRUPTION FOR SOLID STATE NEON SUPPLY

[75] Inventor: David Pacholok, Sleepy Hollow, Ill.

[73] Assignee: Everbrite, Inc., Greenfield, Wis.

[21] Appl. No.: 980,539

[22] Filed: Nov. 23, 1992

[51] Int. Cl.[5] ..... H05B 37/02

[52] U.S. Cl. ..... 315/307; 315/219; 315/DIG. 5; 315/DIG. 7; 315/224; 315/127

[58] Field of Search ..... 315/DIG. 7, 307, DIG. 5, 315/127, 151, 219, 209 R, 224; 361/42

[56] References Cited

U.S. PATENT DOCUMENTS

| | | | |
|---|---|---|---|
| 4,533,854 | 8/1985 | Northrup | 315/151 |
| 4,613,934 | 9/1986 | Pacholok | 315/DIG. 7 |
| 4,870,326 | 9/1989 | Andresen et al. | 315/DIG. 7 |
| 4,920,302 | 4/1990 | Konopka | 315/DIG. 7 |

*Primary Examiner*—Robert J. Pascal
*Assistant Examiner*—Michael B. Shingleton
*Attorney, Agent, or Firm*—Maksymonko & Slater

[57] ABSTRACT

Apparatus for dimming neon tubes and signs in which certain problems associated with high dimming levels (lowered illumination intensities), namely, of tube non-excitation and non-uniform illumination, are eliminated. The apparatus includes a generator for creating pulse groups, which groups consist of one or more high frequency, full-amplitude pulses and a modulator for selectively controlling the repetition rate of the pulse group and/or the number of pulses forming each group. The apparatus further includes ground fault interruption circuitry that is immune from the false triggering occasioned by the low pulse group repetition rate which in turn results in the repeated de-ionization/re-ionization of the neon gas. The ground fault interruption circuitry includes a detector for establishing the initiation of a pulse group and an inhibitor to preclude ground fault interruption during periods of gas re-ionization following the commencement of each pulse group.

5 Claims, 3 Drawing Sheets

DIMMER AND GROUND FAULT INTERRUPTION FOR SOLID STATE NEON SUPPLY

BACKGROUND OF THE INVENTION

The present invention relates to dimmers for use in connection with solid state neon tube power supplies, in particular, to dimmers for high frequency power supplies operating at frequencies generally above 10 Khz.

Most conventional high frequency neon power supplies operate at a fixed current output determined by power supply design and the length of the neon tube or tubes connected thereto. Such supplies are, in short, operated at a single output level corresponding to full or maximum light intensity.

While fixed full-output neon supplies are satisfactory for most applications—usually for outdoor or window advertisement applications —there is growing demand for lower or variable intensity neon signage principally for indoor applications where normal high intensity illumination does not comport with the subdued and darkened atmosphere associated with many food and beverage establishments—common users of neon signage. The present invention, therefore, pertains to a dimmer arrangement for high frequency neon power supplies that permits the continuous adjustment of light output from full intensity down to a low light output level of, for example, about 5–10% thereof.

In certain instances a conventional SCR or triac-type 'conduction angle' or pulse width modulation (PWM) lamp dimmer may be employed to vary the light intensity, particularly where the neon sign is powered from a standard 60 Hz power transformer supply. And it might reasonably be assumed that the PWM dimming scheme could be extrapolated to high frequency neon power supplies as this is the principle upon which many high frequency switching power supplies operate.

Several problems, however, have been encountered when applying PWM dimmer technology to high frequency neon power supplies. These include the non-uniform illumination of the neon tube and the lowering of the output voltage below that necessary to assure neon gas excitation—both phenomena occurring at lower illumination intensities.

As presently understood, the reason for the first of these limitations is related to the distributed tube capacitance which may be as high as 50 picofarads or more. This capacitance progressively shunts tube current to ground along the length of the tube, that is, as viewed by moving from the respective tube ends toward the center. As the voltage across the tube is substantially independent of tube current (actually, the negative resistance characteristic of the neon tube results in a slightly increasing tube voltage with lowering tube currents), this capacitive leakage current is also substantially independent of tube illumination or dimmer setting. For a 20 KHz neon supply and typical neon tube, this current is approximately 12 milliamperes.

By comparison, a neon tube current of about 25 milliamperes is typical for normal (full) neon tube illumination. As these two current components (i.e. tube leakage and tube illumination currents) are in quadrature, a total supply current of under 28 ma results. Thus, it will be appreciated that the leakage current causes only a negligible reduction in neon tube current for normal tube illumination intensities and consequently this gradual current reduction along and toward tube center produces a correspondingly trivial reduction in light intensity.

This is not the case for lower tube illumination intensities, however. Take, for example, a tube dimming of 80%, that is where the desired tube current is 20% of full tube intensity current of 5 ma. For this configuration (i.e. quadrature leakage and illumination currents of 12 and 5 ma, respectively) the total supply current is computed to be 13 ma. It should be observed, however, that the full 13 ma supply current enters the neon tube ends as all of the capacitive leakage and tube neon currents flow through these points. Thus, the tube ends are illuminated not by a mere 5, but a 13, milliampere current.

The current through the center section of the tube (which is at "ground" potential by reason of the balanced nature of the supply output), however, is the previously specified 5 ma —the 12 ma quadrature leakage current having been fully shunted to ground. The tube is therefore illuminated to a 5 ma intensity in the center, but gradually increases to 13 ma at the ends. This differential produces a clearly visible and objectionable illumination non-uniformity that only gets worse as greater dimming levels are selected.

The second limitation of PWM neon supplies relates to the intrinsic low pass filter characteristic of the power supply and neon load. This filter characteristic—which has a cut-off frequency generally of twice the supply operating frequency—is created by the series "leakage" inductance of the high voltage transformer working against the secondary inductance and capacitance and the previously mentioned tube leakage capacitance.

The oscillator output waveform, for ordinary 'full output' operation, is of generally symmetrical form having substantial energy at the fundamental or operating frequency. Thus, the above-mentioned low pass characteristic is of minimal consequence for ordinary operation. However, as the pulse widths are narrowed by the PWM circuitry (as occurs upon dimming with this conventional approach), the relative fundamental energy content of the resulting output waveform drops dramatically. And by reason of the above-discussed low pass filter characteristic, the remaining high frequency harmonic energy is not coupled to the neon tube and therefore does not significantly contribute to the available excitation voltage thereof. As dimming is increased (i.e. as the pulse widths narrow) the neon tube excitation voltage may drop below the requisite ionization potential thereby resulting in erratic and unreliable tube operation, specifically, the failure of the tube to illuminate or an oscillatory-type flickering or blinking thereof.

The present invention pertains to various arrangements to avoid the above-noted dimmer problems and to improvements in ground fault interruption (GFI) circuitry to permit the proper operation thereof. One approach contemplated by the present invention employs a pulse frequency modulation technique in which the repetition rate of so-called "full brilliance" pulses, (i.e. pulses of an amplitude which, if continuous, would effect full tube illumination and, further, of a period that corresponds to a generally optimal power supply operating frequency, e.g. 20 KHz), is selectively adjusted to cause corresponding variations in the average tube current, in turn, to the overall brightness of the luminous tube. It will be appreciated that while the average current may be low, the actual current through the tube during any given pulse corresponds to the full illumination current, e.g. about 25 ma, and therefore that the above-described problems of unequal tube dimming and tube non-excitation are eliminated.

In some instances it has been found that the above dimming arrangement produces objectionable noise in the form of an audible acoustic squeal as dimming levels are increased (i.e. illumination intensities are lowered). As greater "dimming" is selected, the repetition rate of the high frequency (e.g. 25 KHz) pulses is correspondingly lowered and may fall well within the audible range, for example, 500 Hz–10 KHz. More specifically, magneto-restriction and Lenz Law forces effectively serve to create an acoustic transducer which is, in turn, driven by the lowered audio frequency pulses present during reduced intensity power supply operation.

Therefore another embodiment of the present invention is proposed in which groups of high frequency pulses (these pulses, again, being in the order of about 20 KHz) are applied to the luminous tube at a generally low frequency rate. A rate above the so-called "flicker rate" at which the human eye perceives visible flicker, for example about 100 Hz, is preferred. At such a low frequency, the problems of magneto-restriction and Lenz Law induced acoustic noise are greatly reduced and, to the extent that any such noise remains, the low frequency thereof renders the resulting noise less objectionable.

The selective adjustment of dimming is preferably controlled by varying the duration of each of the "pulse groups", that is, the number of high frequency pulse cycles contained therein. In this manner a full range of dimming can be achieved while maintaining the fundamental high frequency excitation and low frequency repetition rates. It will be understood, however, that a combination of the above-described pulse frequency and pulse group modulation techniques may be employed whereby both the repetition rate and number of pulses found in each pulse group may be selectively varied to achieve dimming operation.

Another feature of the present invention relates to ground fault interruption or GFI circuitry. Ground fault interruption—i.e. the switching "off" of the power supply upon the detection of an unexpected and potentially lethal ground path current—has long been the practice and, often, the requirement of applicable safety codes. Ordinary ground fault circuits, however, have been found to incorrectly indicate a ground fault condition when used in conjunction with the pulse group modulation dimmer of the present invention.

It has been found that the low pulse group repetition rate, with its corresponding long "off" periods between sequential pulse groups, allows the neon gas to deionize. In view of the fact that, first, neon does not instantaneously re-ionize upon the corresponding re-application of high voltage and, second, that the neon ionization wavefront does not propagate from each power supply electrode at the same rate, a short term (about 100 uSec) current flow imbalance occurs which imbalance may, in turn, falsely trigger the GFI circuitry.

The present GFI circuit therefore provides a mechanism for detecting the commencement of a new pulse group and a switch means, in turn, for momentarily inhibiting ground fault operation for a period sufficient to assure that any ground fault signals are real and not, as above-described, inducted by idiosyncracies of the neon gas, itself. The total duration of such inhibiting, being in the order of a few hundred microseconds, is not sufficiently long to pose a health hazard.

DESCRIPTION OF THE PREFERRED EMBODIMENT

Figure 1:
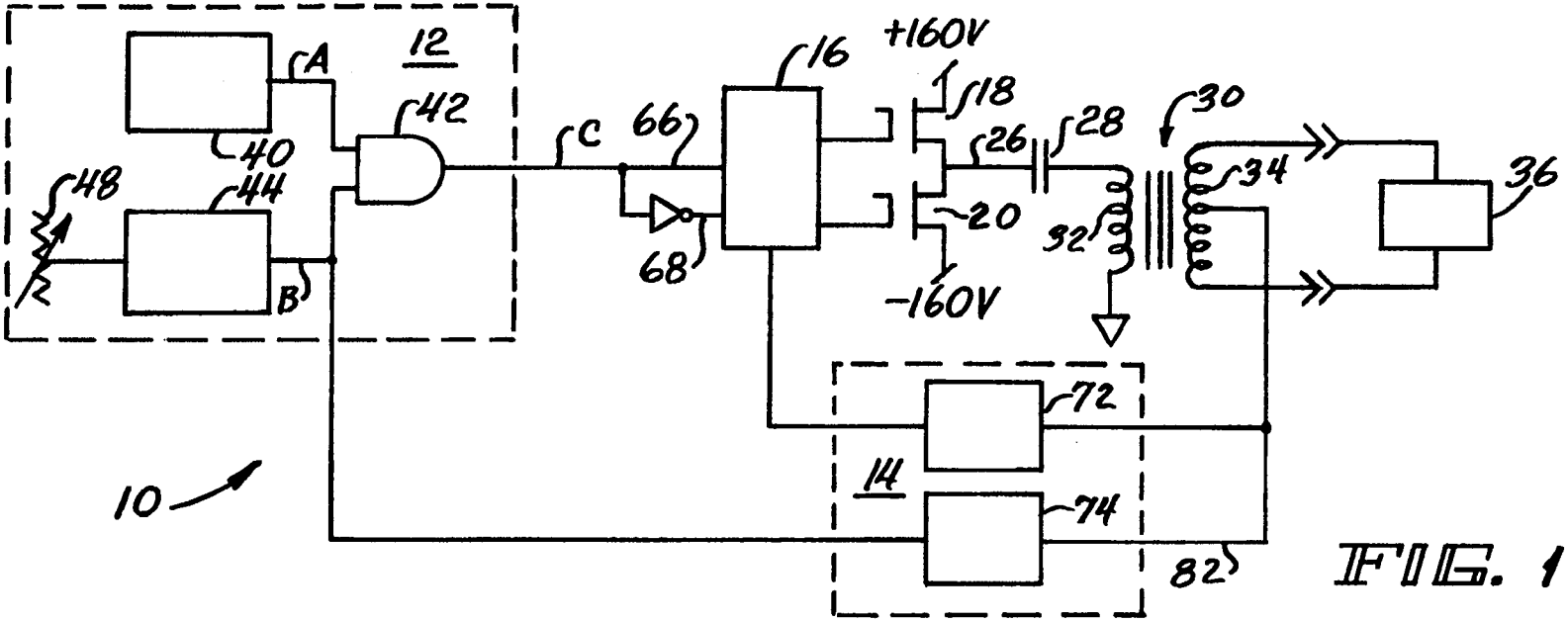
FIG. 1 is a partial schematic and functional block representation of the full range dimmer of the present invention including improved ground fault interruption circuitry.

Referring to FIG. 1, the full range neon tube dimmer and ground fault interruption power supply 10 of the present invention is shown including group pulse modulator 12 and gated ground fault interrupter 14.

The output "C" of modulator 12 (FIG. 3) defines, as described more fully below, a series of high frequency pulse groups, the pulses thereof being connected at the trigger input of a conventional gate driver 16 which, in turn, enables totem-pole connected FETs 18 and 20. More specifically, during each positive pulse (i.e. ordinate value 22, FIG. 3), gate driver 16 switches FET 18 into conduction and FET 20 into cut-off and, visa versa, during each period of zero pulse voltage (i.e. ordinate value 24), FET 18 is switched "off" while FET 20 is "on", or into conduction. It should be apparently, therefore, that waveform "C" is also illustrative of the totem-pole output 26 of the FETs with the exception that the respective ordinate voltages 22 and 24 are +/−160VDC.

A DC blocking capacitor 28 is interposed between the FET output 26 and the primary 32 of the high voltage transformer 30 to effectively decouple the DC component of the output waveform. It will be appreciated that such decoupling is required at increasing dimming levels by reason that the DC component correspondingly increases from zero volts at full intensity (i.e. no dimming) to nearly the full minus 160 volts at maximum dimming. Capacitor 28 may be omitted, however, when the pulse group modulator 60 of FIG. 4, discussed below, is employed.

Referring again to FIG. 1, the high voltage secondary 34 of high frequency step-up transformer 30 is connected to an appropriate luminous neon tube load 36. Significantly, all pulses applied to the primary 32 of transformer 30, regardless of the degree of dimming selected, are of the full peak-to-peak voltage (e.g. +/−160 volts) and therefore the full output voltage is available and applied to the load. Thus, the aforementioned problems of tube non-excitation and non-uniform tube illumination are obviated.

Dimming is effected, not by lowering the instantaneous voltage or current to the load 36, rather by selectively controlling the duty cycle of the full voltage/current pulses thereby controlling the average current through the load. This is preferably achieved through implementation of what is referred to herein as pulse group modulation whereby a fixed, relatively low group modulation repetition rate is selected (to minimize the acoustic noise or squealing that might otherwise occur) to modulate the duration (i.e. number of cycles or pulses in each pulse group) of a high frequency oscillator source. In this manner the full supply peak voltage (and current) is applied to the luminous load 36 while the average value of tube current, and therefore the actual illumination intensity thereof, varies in accordance with the relative duty cycle of the pulse groups.

Pulse group modulator 12 is comprised of a free running high frequency oscillator 40 gated or AND'd at 42 with a variable duty-cycle lower frequency oscillator 44. Oscillator 40 preferably operates at about 25 KHz and produces a symmetric 50/50 square wave output as shown at "A" in FIG. 3. Oscillator 40 may be of the well-known 555 integrated circuit variety.

Figure 2:
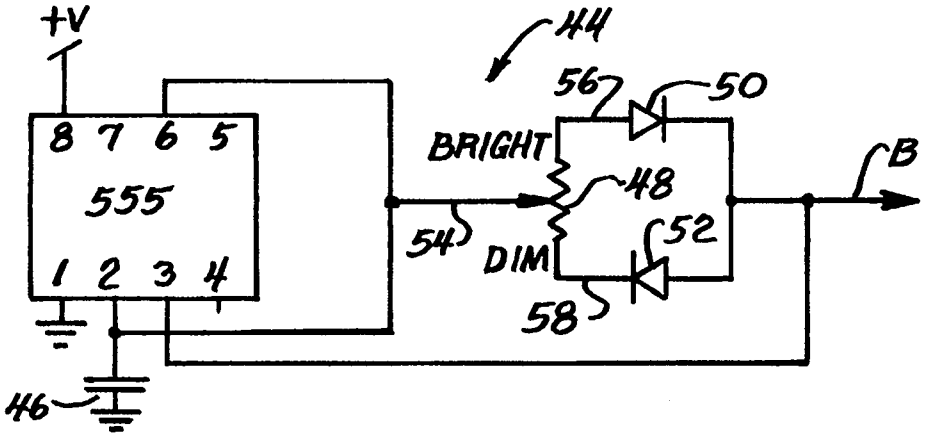
FIG. 2 is a schematic diagram of the fixed frequency group modulation oscillator of FIG. 1.

Low frequency oscillator 44 may also be of the 555 type as is shown in more detail in FIG. 2. Oscillator 44 preferably operates at about 100 Hz—a frequency above the visually perceptible "flicker rate" , yet low enough that acoustic noise problems are minimized. The frequency of operation of oscillator is determined by capacitor 46 and potentiometer 48, typical values for these components are 0.1 $\mu$f and 100K$\Omega$, respectively.

Figure 3:
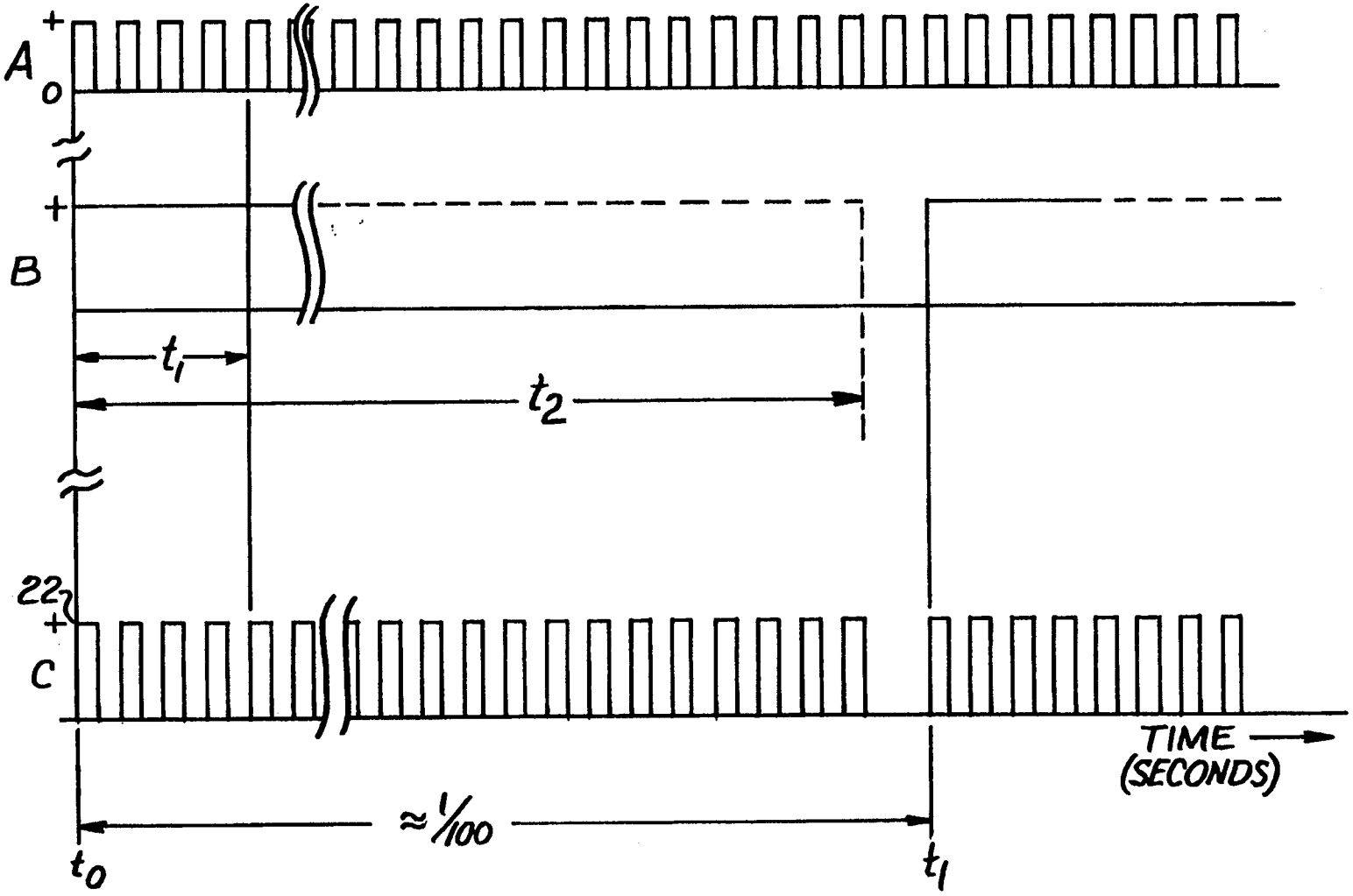
FIG. 3 are waveform diagrams illustrating the waveforms and the relationships therebetween of the high frequency oscillator, the fixed frequency group modulation oscillator, and the modulated output of these oscillators of FIG. 1.

Waveform "B", FIG. 3, illustrates the output waveform of oscillator 44 with pulse durations $T_1$ and $T_2$ corresponding to "dimmed" and "bright" luminous tube operations, respectively.

Referring again to FIG. 2, it will be seen that the "bright" and "dim" sides of potentiometer 48 are connected to oscillator output "B" through respective and opposed diodes 50 and 52. By reason of this opposing diode relationship, capacitor 46 is discharged, when output "B" is low, through diode 50 and the "bright-side" resistance of potentiometer 48 (i.e. the resistance between wiper terminal 54 and the bright-side terminal 56) and is charged, when output "B" is high, through diode 52 and the "dim-side" resistance of potentiometer 48 ( i.e. the resistance between potentiometer terminals 54 and 58).

Thus, as the potentiometer wiper 54 is advanced upwardly toward the "bright" terminal, the bright-side resistance drops and the dim-side resistance increases thereby resulting in corresponding decreases in the discharge and increases in the charge portions of each cycle. As discharge time reflects the "low" portion of the cycle and charge time reflects the "high" portion of the cycle, movement of the potentiometer toward the "bright" terminal increases the "on" period, e.g. $T_2$, and the overall illumination brightness of the tube 36 while, similarly, movement of the potentiometer toward the "dim" terminal decreases the "on" period, e.g. $T_1$, and the overall illumination of the tube. It should again be emphasized that the overall frequency of oscillator 44 remains substantially constant as follows:

$$1/f_{44} \alpha T_{discharge} + T_{charge}$$

$$\alpha C_{46} \cdot R_{brite} + C_{46} \cdot R_{dim}$$

$$\alpha C_{46} \cdot (R_{brite} + R_{dim})$$

And since $(R_{brite}+R_{dim})=R_{48}=R_{total}=$Constant, $f_{44}$ is similarly constant.

Figure 4:
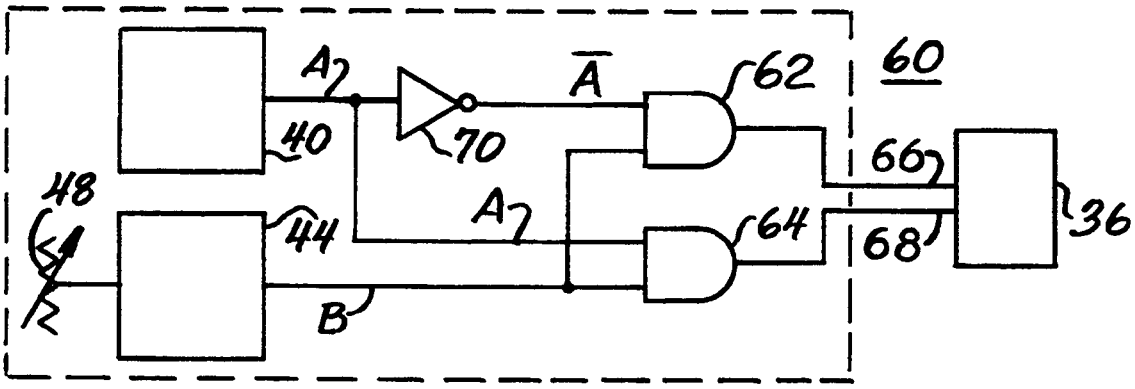
FIG. 4 is a block schematic diagram of an alternative pulse group modulator for use in the dimmer of FIG. 1.

FIG. 4 illustrates an alternative pulse group modulator 60 in which AND gates 62 and 64 inhibit pulses, i.e. assure that a zero signal level is present, on each of the modulator output lines 66 and 68 when the output "B" from low frequency oscillator 44 is low. This, in turn, causes gate driver 16 to switch both FETs 18,20 "off" thereby disconnecting the input power to the primary 32 of transformer 30. When the output "B" of oscillator 44 is high, oscillator 40 output "A" is inverted at 70 and the resulting complementary outputs, A and $\overline{A}$, are passed through gates 62,64, in turn, enabling FETs 18 and 22 in complementary fashion. In this manner, a zero DC offset pulse group modulation is applied to transformer 30 without need for a DC decoupling capacitor such as capacitor 28, FIG. 1.

Also depicted in FIG. 1 is the ground fault interruption circuitry of the present dimmer supply including a conventional ground fault detector 72 and a an inhibitor 74. As noted above, the relatively long off periods associated with the present pulse group dimming arrangement (e.g. 5–10 ms) results in certain transient re-ionization conditions upon the commencement of each pulse group which, in turn, has been found to generate false ground fault detection signals.

Figure 5:
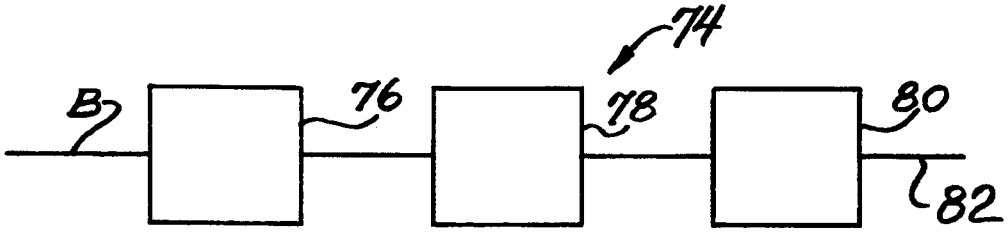
FIG. 5 is a block diagram of the GFI inhibitor of the present invention; and, FIG. 6 is a schematic diagram of the GFI inhibitor of FIG. 5.

FIGS. 5 is a block representation of the ground fault inhibitor 74 of the present invention and is comprised of a pulse group detector 76 connected to the output "B" of oscillator 44, an inhibit timer 78, and a shunt gate 80, the output 82 of which is connected to the GFI input and serves, when enabled, to shunt any ground fault currents from the GFI input thereby defeating or inhibiting GFI operation during these "shunt" periods. More specifically, detector 76 responds to the first rising edge of each new pulse group (e.g. $t_0$ and $t_1$, FIG. 3), triggers timer 78 which, during the timing duration thereof, enables the shunting function of gate 80.

Figure 6:
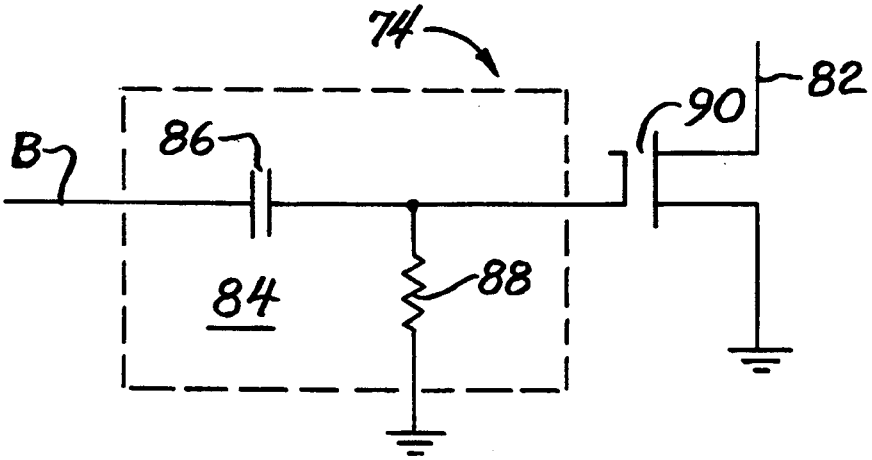

Referring to FIG. 6, the detection and timing functions 76 and 78 are achieved through a single differentiator 84 comprised of a series capacitor 86 and shunt resistor 88. As is well known, the output of differentiator 84 instantaneously rises and tracks the leading edge of the low frequency oscillator output "B", thereafter decaying toward zero volts in accordance with the time constant of the resistor/capacitor combination. In the present case, the above-noted transient condition is in the order of about 100 $\mu$Sec and therefore a somewhat longer differentiator time constant, for example between 200–300 $\mu$Sec, is selected to assure termination of the transient condition prior to the return of normal GFI operation.

A FET 90 is connected to the output of differentiator 84 and serves the shunting function 80 which, as noted, redirects any ground fault current from the normal ground fault interrupter 72 while the gate input signal level remains above its threshold level, A noted above, alternative embodiments of the present invention include use of short duration pulse groups (containing as few as one pulse per group) with brightness control being achieved through the selective adjustment of the pulse group repetition rate. Further, it will be appreciated that a combination of these embodiments, including varying both the pulse group duration and repetition rate may be employed consistent with the teachings herein.

I claim:

1. A dimmable power supply for neon and other gaseous luminous tubes including means for generating substantially periodic pulse groups, each pulse group comprising one or more high frequency pulses, the amplitude of the pulses being that required to produce substantially full illumination of a gaseous tube load during said pulses, the pulse groups having a repetition rate lower in frequency than that of the high frequency pulses; the means for generating pulse groups including a high frequency, high voltage step-up transformer having a secondary for connection to a gaseous luminous tube and a primary, dc power supply means, switch means for connecting the dc power supply to the transformer primary and for reversing the polarity of such connection in response to signals on the inputs of the switch means, a high frequency oscillator, digital gate means for selectively connecting the high frequency oscillator to the switch means inputs whereby full amplitude high frequency pulses are applied to the luminous tube when the high frequency oscillator is thus connected and whereby no output pulses are applied to the luminous tube when the digital gate means disconnects the high frequency oscillator from the switch means input; low frequency oscillator means having a periodic output between first and second output states, the output thereof being operatively connected to the digital gate means whereby the high frequency oscillator is gated to the switch means input in correspondence with one of said low frequency oscillator output states; control means for varying the relative durations of the first and second low frequency output states whereby luminous tube intensity may be adjusted by selectively adjusting the relative duration of full intensity high frequency pulse groups applied to the luminous tube.

2. A dimmable power supply for neon and other gaseous luminous tubes including means for generating substantially periodic pulse groups, each pulse group comprising one or more high frequency pulses, the pulse groups having a low frequency repetition rate; ground fault interruption means for disabling power supply operation upon the detection of a ground fault current condition; ground fault inhibitor means for disabling ground fault interruption during periods of potentially false ground fault current detection.

3. The dimmable power supply for neon and other gaseous luminous tubes of claim 2 in which the ground fault inhibitor disables the ground fault interruption means for a predetermined interval following the commencement of each new high frequency pulse group.

4. The dimmable power supply for neon and other gaseous luminous tubes of claim 3 in which the ground fault inhibitor includes means for detecting the commencement of a new high frequency pulse group, switch means for disabling the ground fault interruption means, and timer means whereby the switch means disables the ground fault interruptor means upon detection of a new pulse group and for the predetermined interval thereafter as determined by the timer means.

5. The dimmable power supply for neon and other gaseous luminous tubes of claim 3 in which the predetermined interval is between 75–500 $\mu$Seconds thereby minimizing possible false ground fault interruptions occasioned by transient pulse group conditions while assuring substantial ground fault protection in the event of an actual ground fault condition.

* * * * *